US006761541B1

(12) United States Patent
Clendenin

(10) Patent No.: US 6,761,541 B1
(45) Date of Patent: Jul. 13, 2004

(54) FOOT PLATE FOR HERMETIC SHELL

(75) Inventor: Harry Clendenin, Sidney, OH (US)

(73) Assignee: Copeland Corporation, Sidney, OH (US)

( * ) Notice: Subject to any disclaimer, the term of this patent is extended or adjusted under 35 U.S.C. 154(b) by 225 days.

(21) Appl. No.: 09/496,486

(22) Filed: Feb. 2, 2000

(51) Int. Cl.[7] ..... F04B 35/00
(52) U.S. Cl. ..... 417/360; 417/363; 417/423.15
(58) Field of Search ..... 417/363, 360, 417/902, 423.15; 248/346.01, 678, 677

(56) References Cited

U.S. PATENT DOCUMENTS 5,277,554 A * 1/1994 Elson ..... 417/363

* cited by examiner

*Primary Examiner*—Cheryl J. Tyler
(74) *Attorney, Agent, or Firm*—Harness, Dickey & Pierce, P.L.C.

(57) ABSTRACT

A foot plate for mounting a compressor includes a mounting plate, a pair of upwardly extending flanges, a pair of downwardly extending flanges and an upwardly extending mounting flange. The mounting flange is utilized to secure a compressor by being attached to the shell of the compressor. When tandem compressor assemblies are used, the pair of upwardly extending flanges provide clearance for a pair of rails which interconnect the tandem compressors without having to modify the foot plates. In one embodiment, the foot plates are welded or brazed to the rails. In another embodiment, a set of grommets position the foot plate on the rail and the foot plate is bolted to the rail. In another embodiment, a set of grommets position and secure the foot plate to the rail.

20 Claims, 4 Drawing Sheets

FIG. 6.
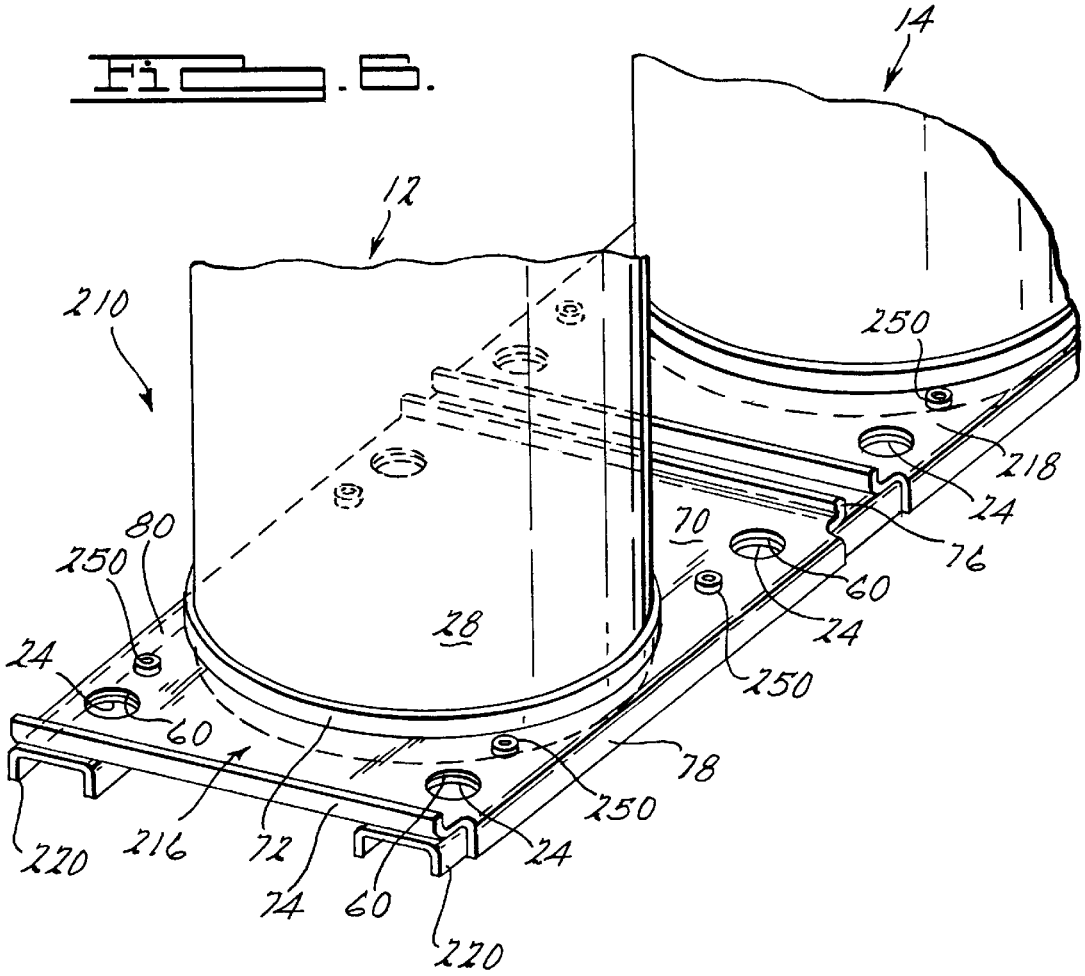
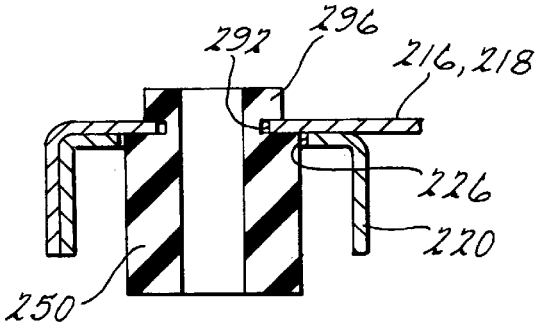
FIG. 7.
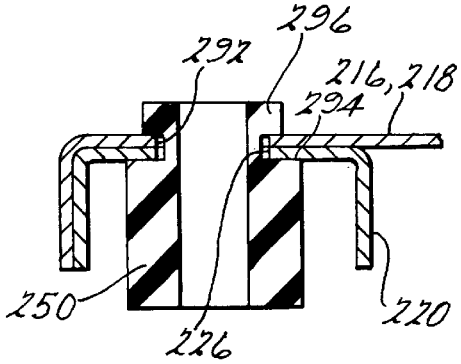
FIG. 8.

FOOT PLATE FOR HERMETIC SHELL

FIELD OF THE INVENTION

The present invention relates to mounting and suspension systems. More particularly, the present invention relates to a foot plate for mounting or suspending a tandem compressor system on a pair of channel rails.

BACKGROUND AND SUMMARY OF THE INVENTION

Hermetic compressors comprise a motor compressor unit disposed within a hermetically sealed outer housing or shell. An electrical connection to the motor is made via a terminal which extends through a sidewall of the housing or shell. Fluid conduits also extend through the housing or shell to provide an external connection to the refrigeration system or other system to which the compressor is connected. When using tandem compressor units, the compressors are mounted adjacent to each other with the fluid conduits, both suction and discharge, coming together to form a single suction inlet fitting and a single discharge outlet fitting of the connection of the tandem compressor system to the refrigerant system or other system. In addition to the connection between the suction inlet and the discharge outlet, the tandem compressors may also be interconnected by one or more pairs of equalization tubes also extending through the sidewalls of the housing or shell. One equalization tube is normally positioned at a high elevation, above the level of oil in an oil sump located in the bottom of the housing or shell. This high elevation equalization tube provides for the equalization of the gas pressure within the housings or shells. The second equalization tube is normally located near the bottom of the housing or shell, coincident with the desired level of lubricant or oil within the housing or shell. This low elevation equalization tube provides for the equalization of the oil levels between the two compressor units.

Various prior art structures have been used to mount single compressors and these structures have also been utilized for the mounting of tandem compressors. As shown in FIG. 1, the prior art system for mounting a single compressor is shown. In FIG. 1, a compressor 110 is secured to a foot plate 112 by welding the housing or shell of compressor 110 to an upturned generally circular flange 114. The bottom cover or lower portion of the housing or shell of compressor 110 is typically domed in some manner as shown in FIG. 1. This domed feature of the housing or shell requires foot plate 112 to include four downwardly turned flanges 116, 118, 120 and 122. The length of flanges 116–122 are designed to be greater than the length of the housing or shell extending through foot plate 112 to provide a secure mounting surface for compressor 110.

While foot plate 112 shown in FIG. 1 works adequately for mounting a single compressor, there are problems encountered when a tandem compressor system is to be mounted. The typical method for mounting tandem compressors is to provide a pair of parallel mounting rails 124 to which two compressors 110 and two foot plates 112 are secured. Because foot plate 112 includes four downward turned flanges 116–122, both ends of two opposing flanges 116 and 118 or 120 and 122 must be reworked or machined as shown at 126 in FIG. 1 to provide clearance for the pair of parallel mounting rails.

The present invention addresses this problem by having a foot plate with one pair of opposing flanges extending in one direction while having the other pair of opposing flanges extending in the opposite direction. This provides clearance for the parallel mounting rails while still providing sufficient support for mounting a single compressor unit on a single foot plate if desired.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention:

FIG. 6 is a perspective view of a portion of a tandem compressor system mounted on parallel rails using a foot plate in accordance with another embodiment of the present invention;

FIG. 7 is a cross-sectional view of the grommets illustrated in FIG. 6; and FIG. 8 is a cross-sectional view of a grommet in accordance with another embodiment of the present invention.

DETAILED DESCRIPTION OF THE PREFERRED EMBODIMENT

Figure 2:
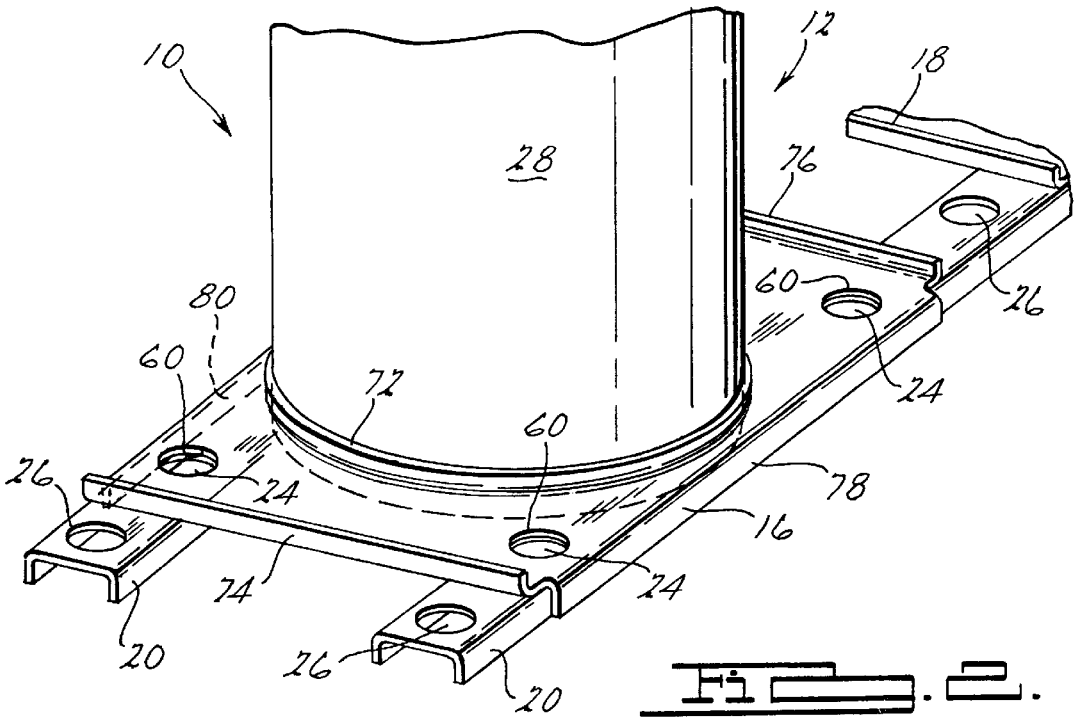
FIG. 2 is a perspective view of a portion of the tandem compressor system mounted on parallel rails using the foot plate in accordance with the present invention.
Figure 3:
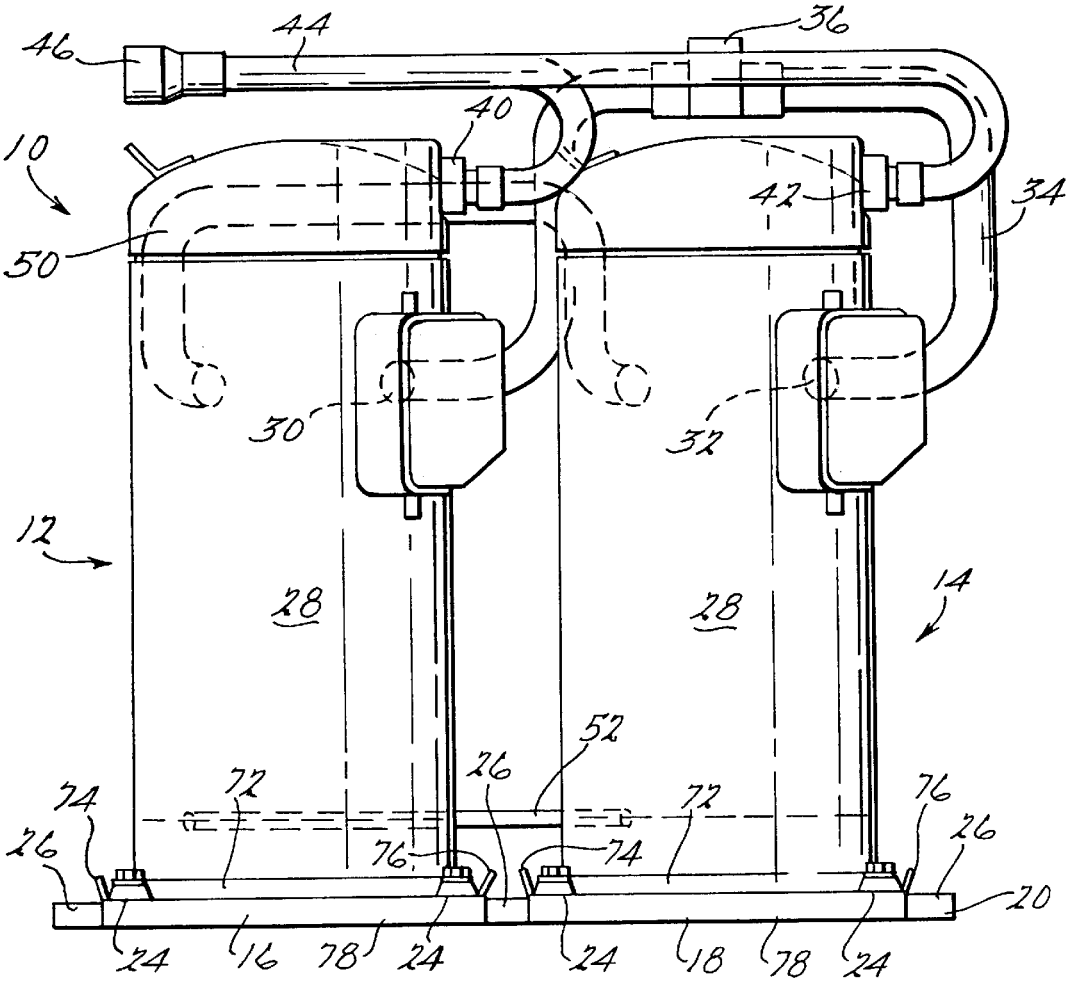
FIG. 3 is a side view of the tandem compressor system shown in FIG. 2.

Referring now to the drawings in which like reference numerals designate like or corresponding parts throughout the several views, there is shown in FIGS. 2 and 3 a tandem compressor system 10 in accordance with the present invention. Tandem compressor system 10 comprises a first hermetic compressor 12, a second hermetic compressor 14, a first foot plate 16, a second foot plate 18 and a pair of common rails 20.

Common rails 20 longitudinally extend generally parallel to each other with each rail 20 being spaced apart from the other rail 20 a specified distance. Each rail 20 includes four apertures 24, two each for mounting each of compressors 12 and 14. Each rail 20 also includes three apertures 26, two disposed at opposite ends of rail 20 and one located at the center of rail 20. Apertures 26 are designed to be utilized for mounting rails 20 and thus tandem compressor system 10 to a generally horizontal surface or an apparatus.

Hermetic compressor 12 is generally identical to hermetic compressor 14 and each compressor comprises a cylindrical hermetic shell 28 fixedly attached by welding or brazing to foot plate 16 and to foot plate 18, respectively. Each hermetic shell 28 is hermetically sealed by welding or brazing and may include a bottom cap. When shell 28 includes a bottom cap, foot plate 16 and 18 can be welded or brazed to the foot plate itself or to the cylindrical portion of hermetic shell 28. Disposed within each shell 28 is a motor compressor unit comprising an electric motor (not shown) and a rotary compressor mechanism (not shown). While the present invention is being described, for exemplary reasons, as a rotary compressor mechanism, the present invention is equally applicable to other types of compressor mechanisms as well.

Compressors 12 and 14 are interconnected by a series of tubes. A suction port 30 of compressor 12 is fluidically connected to a suction port 32 of compressor 14 by a fluid tube 34. A suction fitting 36 is provided to commonize access to both suction ports 30 and 32. A discharge port 40 of compressor 12 is fluidically connected to a discharge port 42 of compressor 14 by fluid tube 44. A discharge fitting 46 is provided to commonize access to both discharge ports 40 and 42. A pair of equalization tubes 50 and 52 are also provided for the interconnection of compressors 12 and 14. Tube 50 is located at a higher elevation than tube 52 above the level of oil in shells 28 to provide for the equalization of the gases within shells 28. Tube 52 is located at the lower portion of shells 28, coincident with the level of oil in shells 28 to provide for the equalization of the oil levels within shell 28.

Each foot plate 16 and 18 is attached to rails 20 by welding, brazing or being bolted using four apertures 60 which correspond to and align with four apertures 24, two in each of the pair of common rails 20. Foot plate 16 is identical to foot plate 18. Thus, the detailed description for foot plate 16 also applies to foot plate 18.

Figure 1:
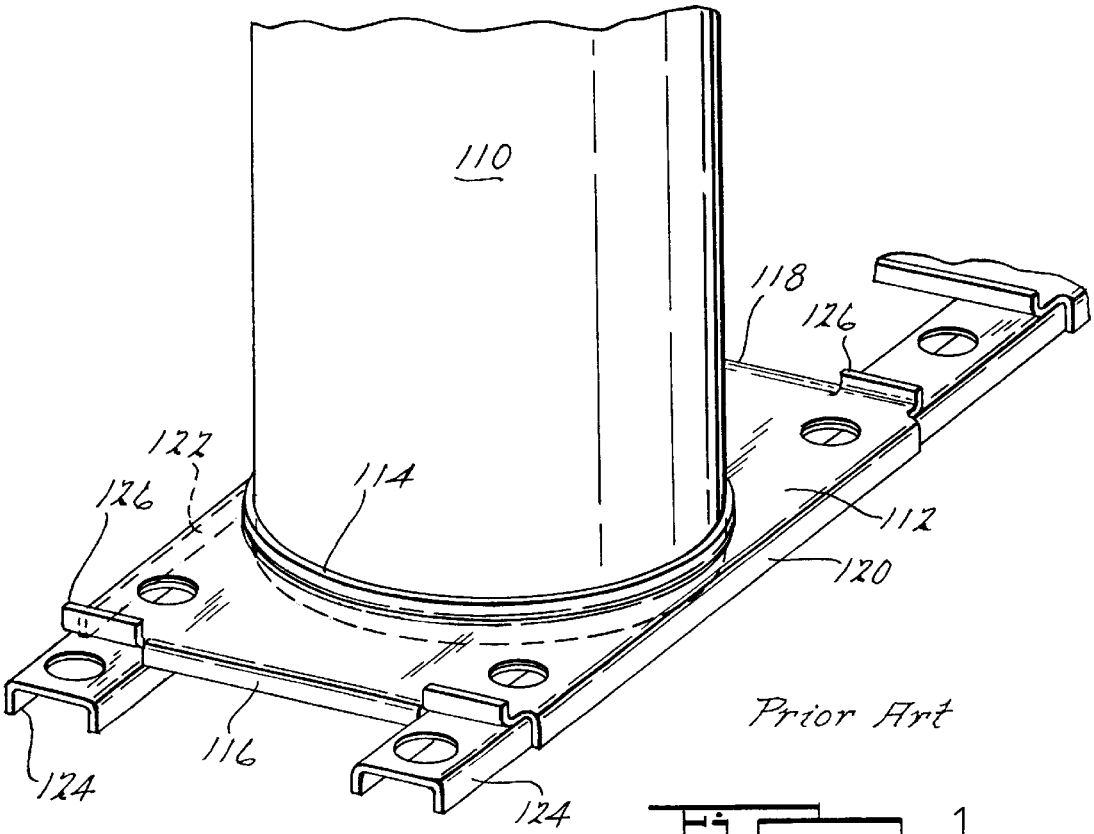
FIG. 1 is a perspective view illustrating a mounting system for a prior art compressor unit.
Figure 4:
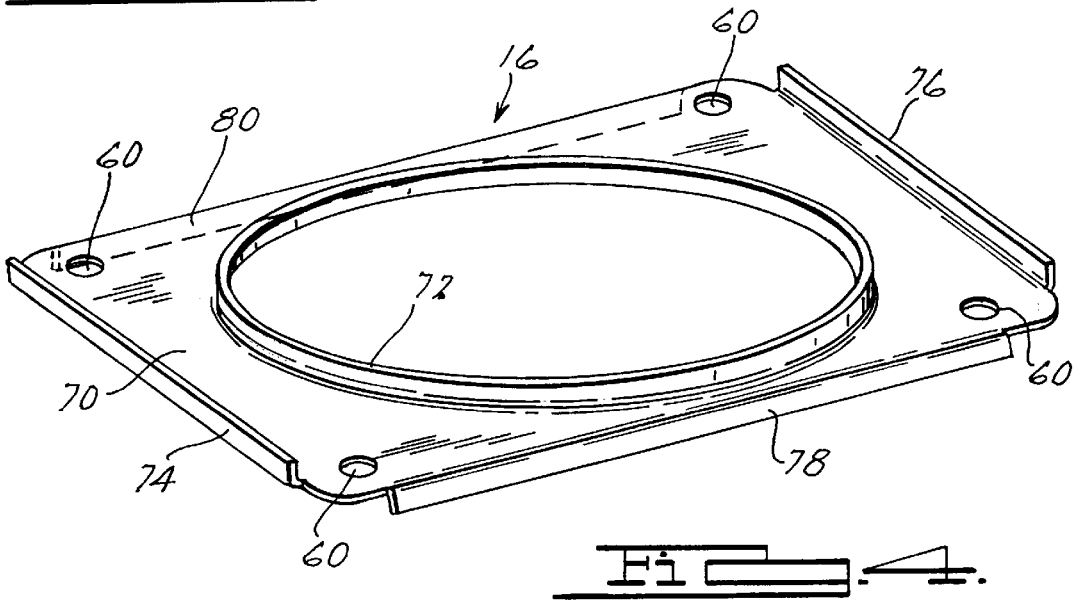
FIG. 4 is a perspective view of a foot plate in accordance with the present application.
Figure 5:
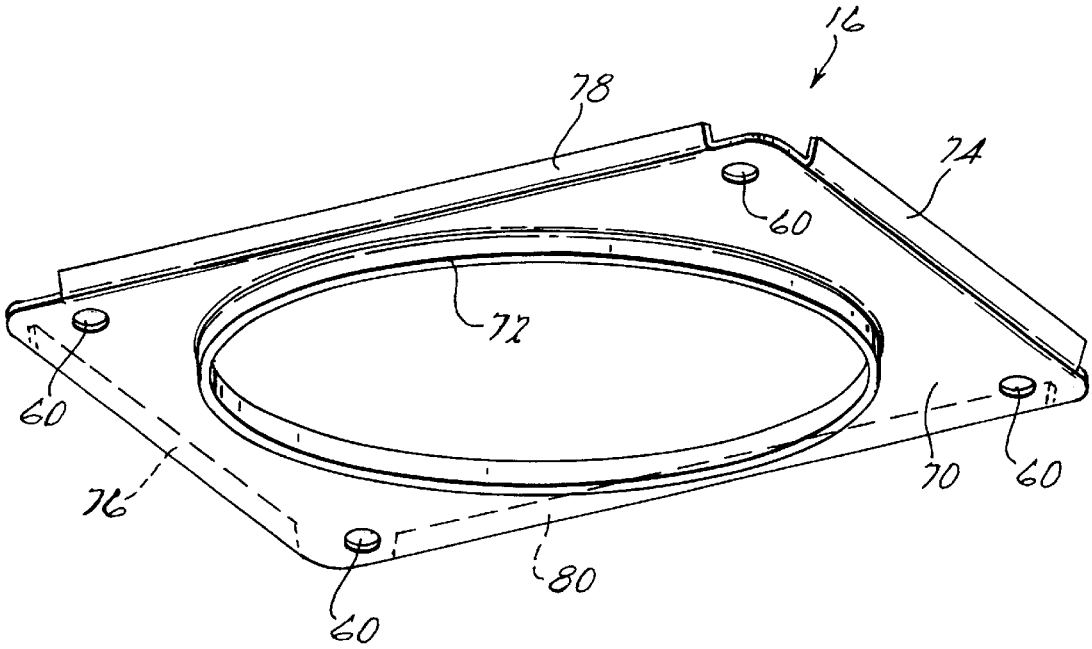
FIG. 5 is a perspective view of a foot plate in accordance with another embodiment of the present invention.

Foot plate 16 is shown in FIG. 4. Foot plate 16 comprises a generally planar mounting plate 70 having the centrally located generally cylindrical upturned flange 72 to which shell 28 is fixedly attached by welding or brazing. While flange 72 is being illustrated for exemplary purposes as an upturned flange, it is within the scope of the present invention to design flange 72 as a downturned flange as shown in FIG. 5 or foot plate 16 can be designed without flange 72 with shell 29 attached directly to plate 70 if desired. Apertures 60 are located radially outward from flange 72 and each aperture 60 is located approximately 90° from two other apertures 60. A first pair of flanges 74 and 76 extend upwardly as shown in FIG. 4 in the same direction as flange 72. A second pair of flanges 78 and 80 extend downwardly as shown in FIG. 4 in the opposite direction to flange 72. As shown in FIG. 2, one rail 20 is disposed adjacent to flange 78 while the other rail 20 is disposed adjacent to flange 80. Each rail 20 rests against and thus support the lower surface of generally planar plate 70. Each rail 20 is allowed to abut the lower surface of generally planar plate 70 because flanges 74 and 76 are turned upward or in the opposite direction to flanges 78 and 80. In the prior art, flanges 74 and 76 (116 and 118 in FIG. 1) are turned downwardly in the same direction as flanges 78 and 80 (120 and 122 in FIG. 1). Thus, when the prior art foot plates are to be secured to rails 124, rails 124 interfere with the down turned flanges 116 and 118 necessitating the need to rework flanges 116 and 118 as shown at 126. By providing upturned flanges 74 and 76 instead of flanges 116 and 118, there is no need to rework foot plates 16 and thus a common foot plate 16 can be utilized for either a single compressor mounting or a tandem (or more) compressor mounting system. When used as a single compressor mount, downward turned flanges 78 and 80 provide sufficient support for the mounting of the compressor.

For exemplary purposes, flanges 74 and 76 are illustrated for as being upturned flanges and flanges 78 and 80 are downturned flanges, it is within the scope of the present invention to have all four flanges 74, 76, 78 and 80 designed as upturned flanges. These four upturned flanges can then be used in conjunction with either an upturned flange 72, a downturned flange 72, or without a flange 72 where shell 28 is welded directly to the planar surface of foot plate 16 as shown in FIG. 5.

Referring now to FIGS. 6–8, a tandem compressor system 210 in accordance with another embodiment of the present invention is disclosed. Tandem compressor system 210 comprises first hermetic compressor 12, second hermetic compressor 14, a first foot plate 216, a second foot plate 218 and a pair of common rails 220.

Common rails 220 longitudinally extend generally parallel to each other with each rail 220 being spaced apart from the other rail 220 a specified distance. Each rail 220 includes the four apertures 24, two for mounting compressor 12 and two for mounting compressor 14. Each rail 220 also includes four apertures 226, two for mounting foot plate 216 and two for mounting foot plate 218.

Compressor 12 is welded or brazed to foot plate 216 in the same manner that compressor 12 is welded to foot plate 216. Also, compressor 14 is welded or brazed to foot plate 218 in the same manner that compressor 12 is welded to foot plate 18.

Each foot plate 216 and 218 is attached to rails 220 by utilizing four grommets 250 as shown in FIG. 7. In addition, four bolts using four apertures 60 which extend through plates 216 and 218 and which correspond to and align with the four apertures 24 for each compressor are utilized to attach each foot plate 216 and 218 to rails 220. Foot plate 216 is identical to foot plate 218. Thus, the detailed description for foot plate 216 also applies to foot plate 218.

Foot plate 216 is similar to foot plate 16 and it comprises generally planar mounting plate 70 having the centrally located generally cylindrical upturned flange 72 to which shell 28 is fixedly attached by welding or brazing. While flange 72 is illustrated for exemplary purposes as an upturned flange, it is within the scope of the present invention to design flange 72 as a downturned flange as shown in FIG. 5 or foot plate 216 can be designed without flange 72 with shell 28 attached directly to plate 70 if desired. Apertures 60 are located radially outward from flange 72 and each aperture 60 is located approximately 900 from two other apertures 60. A first pair of flanges 74 and 76 extend upwardly as shown in FIG. 6 in the same direction as flange 72. A second pair of flanges 78 and 80 extend downwardly as shown in FIG. 6 in a direction opposite to flange 72. As shown in FIG. 6, one rail 20 is disposed adjacent to flange 78 where he other rail 20 is disposed adjacent to flange 80. Each rail 20 rests against and thus supports the lower surface of generally planar plate 70. Each rail 20 is allowed to abut the lower surface of generally planar plate 70 because flanges 74 and 76 are turned upward or in the opposite direction to flanges 78 and 80 as described above for foot plate 16.

In order to accommodate the four grommets 250 for foot plate 216 (and foot plate 218), common rails 220 each include four apertures 290 (two for foot plate 216 and two for foot plate 218) and foot plates 216 and 218 each included four apertures 292. As shown in FIG. 7, grommet 250 extends through a respective aperture 290 and a respective aperture 292 to locate foot plate 216 and foot plate 218 with respect to common rails 220. Grommet 250 is an elastomeric member which can easily be deformed to be positioned within apertures 290 and 292. Once foot plates 216 and 218 have been located with respect to common rails 220, the plurality of bolts can be assembled through apertures 24 and 60 to secure foot plates 216 and 218 to common rails 220.

Referring now to FIG. 8, an optional construction for apertures 290 and 292 is illustrated. In FIG. 8, aperture 292 is sized to be slightly larger than the outside diameter of grommet 250. Thus, the plurality of bolts assembled through apertures 24 and 60 are required to secure foot plates 216 and 218 to common rails 220. In FIG. 8, aperture 292 is sized to be generally equal to the size of aperture 290 which is smaller than the outside diameter of grommet 250. With this design, common rail 220 rests on a shoulder 294 defined by grommet 250 with foot plate 216 resting on common rail 220. Grommet 250 includes an annular retaining flange 296 which is assembled through apertures 290 and 292 to sandwich foot plate 216 or foot plate 218 between shoulder 294 and annular retaining flange 296. The elastic nature of grommet 250 allows for its assembly through apertures 290 and 292 but grommet 250 is stiff enough to retain foot plate 216 or foot plate 218 to common rail 220. The utilization of the design shown in FIG. 8 allows for the elimination of apertures 24 in common rail 220 and apertures 60 in foot plate 216 and 218.

The utilization of grommets 250 in both embodiments shown in FIGS. 7 and 8 allow for the use of shorter common rails 220, the elimination of apertures 26, and the reduction of the number of parts needed to install this system. Thus, the advantages offer significant cost savings for the manufacturer of the compressors.

While the above detailed description describes the preferred embodiment of the present invention, it should be understood that the present invention is susceptible to modification, variation and alteration without deviating from the scope and fair meaning of the subjoined claims.

What is claimed is:

1. A hermetic compressor assembly comprising:

a first hermetic compressor having a first shell;

a first foot plate attached to said first shell, said first foot plate defining a first mounting plate having a length and a width;

a first upwardly extending pair of flanges attached to said first mounting plate and extending substantially the entire width of said first mounting plate in a first direction relative to said first mounting plate; and a first downwardly extending pair of flanges attached to said first mounting plate and extending substantially the entire length of said first mounting plate in a second direction relative to said first mounting plate, said second direction being opposite to said first direction.

2. The hermetic compressor assembly according to claim 1, further comprising an upwardly extending mounting flange attached to said first mounting plate and extending in said first direction,-said mounting flange being attached to said first shell.

3. The hermetic compressor assembly according to claim 1, further comprising a downwardly extending mounting flange attached to said first mounting plate and extending in said second direction, said mounting flange being attached to said first shell.

4. The hermetic compressor assembly according to claim 1, further comprising:

a second hermetic compressor having a second shell;

a second foot plate attached to said second shell, said second foot plate defining a second mounting plate having a length and a width;

a second upwardly extending pair of flanges attached to said second mounting plate and extending substantially the entire width of said second mounting plate in said first direction;

a second downwardly extending pair of flanges attached to said second mounting plate and extending substantially the entire length of said mounting plate in said second direction.

5. The hermetic compressor assembly according to claim 4, further comprising:

a first upwardly extending mounting flange attached to said first mounting plate and extending in said first direction, said first mounting flange being attached to said first shell;

a second upwardly extending mounting flange attached to said second mounting plate and extending in said first direction, said second mounting flange being attached to said second shell.

6. The hermetic compressor assembly according to claim 5, further comprising:

a first rail extending between said first and second foot plates; and a second rail extending between said first and second foot plates.

7. The hermetic compressor according to claim 6, wherein said first rail is disposed adjacent said first and second mounting plates.

8. The hermetic compressor according to claim 7, wherein said first rail is disposed adjacent one of said first downwardly extending pair of flanges and adjacent one of said second downwardly extending pair of flanges.

9. The hermetic compressor according to claim 6, wherein said second rail is disposed adjacent said first and second mounting plates.

10. The hermetic compressor according to claim 9, wherein said first rail is disposed adjacent one of said first downwardly extending pair of flanges and adjacent one of said second downwardly extending pair of flanges and said second rail is disposed adjacent the other of said first downwardly extending pair of flanges and adjacent the other of said second downwardly extending pair of flanges.

11. The hermetic compressor assembly according to claim 4, further comprising:

a first downwardly extending mounting flange attached to said first mounting plate and extending in said second direction, said first mounting flange being attached to said first shell;

a second downwardly extending mounting flange attached to said second mounting plate and extending in said second direction, said second mounting flange being attached to said second shell.

12. The hermetic compressor assembly according to claim 4, further comprising:

a first rail extending between said first and second foot plates; and a second rail extending between said first and second foot plates.

13. The hermetic compressor according to claim 12, wherein said first rail is disposed adjacent said first and second mounting plates.

14. The hermetic compressor according to claim 13, wherein said first rail is disposed adjacent one of said first downwardly extending pair of flanges and adjacent one of said second downwardly extending pair of flanges.

15. The hermetic compressor according to claim 12, wherein said second rail is disposed adjacent said first and second mounting plates.

16. The hermetic compressor according to claim 15, wherein said first rail is disposed adjacent one of said first downwardly extending pair of flanges and adjacent one of said second downwardly extending pair of flanges and said second rail is disposed adjacent the other of said first downwardly extending pair of flanges and adjacent the other of said second downwardly extending pair of flanges.

17. The hermetic compressor according to claim 12, further comprising a first plurality of grommets engaging said first foot plate and said first and second rails.

18. The hermetic compressor according to claim 17, wherein each of said first plurality of grommets defines a shoulder and an annular ridge, said first foot plate and said first rail being sandwiched between a first respective shoulder and a first respective annular ridge, said first foot plate and said second rail being sandwiched between a second respective shoulder and a second respective ridge.

19. The hermetic compressor according to claim 17, further comprising a second plurality of grommets engaging said second foot plate and said first and second rails.

20. The hermetic compressor according to claim 19, wherein each of said first and second plurality of grommets defines a shoulder and an annular ridge, said first foot plate and said first rail being sandwiched between a first respective shoulder and a first respective annular ridge, said second foot plate and said second rail being sandwiched between a second respective shoulder and a second respective ridge.

* * * * *

UNITED STATES PATENT AND TRADEMARK OFFICE

CERTIFICATE OF CORRECTION

PATENT NO. : 6,761,541 B1
DATED : July 13, 2004
INVENTOR(S) : Harry Clendenin

It is certified that error appears in the above-identified patent and that said Letters Patent is hereby corrected as shown below:

Column 4,
Line 36, “900” should be -- 90º --.
Line 42, “he” should be -- the --.
Line 52, “included” should be -- include --.

Signed and Sealed this

Seventh Day of September, 2004

JON W. DUDAS
*Director of the United States Patent and Trademark Office*